United States Patent [19]

Ribas et al.

[11] 4,332,104

[45] Jun. 1, 1982

[54] CLOCKWORK MOTORS FOR TOY VEHICLES

[75] Inventors: Jean-Louis Ribas, Saint Priest; Jean-Paul Raharinosy, Caluire, both of France

[73] Assignee: Societe Anonyme "Majorette", Caluire, France

[21] Appl. No.: 116,725

[22] Filed: Jan. 30, 1980

[51] Int. Cl.[3] ..... A63H 17/00

[52] U.S. Cl. ..... 46/206

[58] Field of Search ..... 46/206–209, 46/202

[56] References Cited

U.S. PATENT DOCUMENTS 3,812,933 5/1974 Darda ..... 46/206
3,981,098 9/1976 Darda ..... 46/206
4,135,329 1/1979 Kennedy ..... 46/206
4,192,093 3/1980 Hamano ..... 46/206

*Primary Examiner*—Gene Mancene
*Assistant Examiner*—Michael J. Foycik
*Attorney, Agent, or Firm*—Dowell & Dowell

[57] ABSTRACT

The present invention relates to clockwork motors for toy vehicles of the type wherein depressing of the vehicle toward a rolling surface engages winding pinions which wind the propulsion spring as the vehicle is rolled against the supporting surface. The spring is housed in a casing to which one end is attached and the casing drives the wheel axle through one gear train. The other end of the spring is attached to a hub journaled in the casing and the spring can be wound by rotation of the hub which is accomplished by said winding pinions when engaged with a gear on the axle.

11 Claims, 9 Drawing Figures

CLOCKWORK MOTORS FOR TOY VEHICLES

The present invention relates to improvements in or relating to clockwork motors for toy vehicles and more particularly to those which are wound up by moving the toy to and fro on a horizontal plane or the like.

Motors of this type are known, of which only one end of the spring is connected to the works driving the axle, its other end being fixed. In other motors, the two ends of the spring are associated with axle driving works. Mechanisms are then provided so that the spring can be wound up whatever the direction of advance of the toy. A motor of this type comprises a rigid axle which is not capable of being displaced transversely as it pivots in holes in the sides. The motor comprises a reversing pinion displaced obliquely against the reaction of a spring when the user presses on the bodywork of the toy so that said pinion comes into mesh, or not, with a pinion carried by the axle of the wheels. Such a motor is, for example, described in French Pat. No. 71 13965, corresponding with U.S. Pat. No. 3,981,098, but it is of complicated construction, which considerably increases its cost price.

Other motors of the type in question also exist, but they do not enable their spring to be suitably wound up, with the result that the distance covered by the toy is too short.

It is believed that the above-described way of winding up is not entirely satisfactory as the spring is completely wound up by subjecting the toy vehicle to a total displacement distance which is double that which is effectively necessary.

It is an object of the improvements according to the present invention to remedy the above drawbacks and to produce a motor for toy vehicle, with spiral spring, which is wound up during each direction of its to and fro displacement and which require only a small number of members intended for winding up, to render it economical.

According to a first embodiment of the invention, the axle of the wheels is inclined as a result of a downward thrust made on the bodywork so that a pinion carried by this axle meshes with a sliding displaceable pinion so that the latter actuates a winding up wheel integral with the inner end of the spiral spring with a view to winding it when the toy is displaced in one direction, or the pinion releases this wheel when the toy is displaced in the opposite direction, the rotation of said winding up wheel then being blocked in one way.

According to a preferred variant embodiment, the motor further includes a second sliding pinion always in mesh with an intermediate toothed wheel which in turn meshes with the aforesaid pinion carried by the axle when the bodywork is lowered so that, in one direction of displacement, the second sliding pinion drives with the winding up wheel in the winding direction as soon as it is disengaged from the first sliding pinion driven by movement of the vehicle in the opposite direction.

The invention will be more readily understood on reading the following description with reference to the accompanying drawings, in which.

Figure 7:
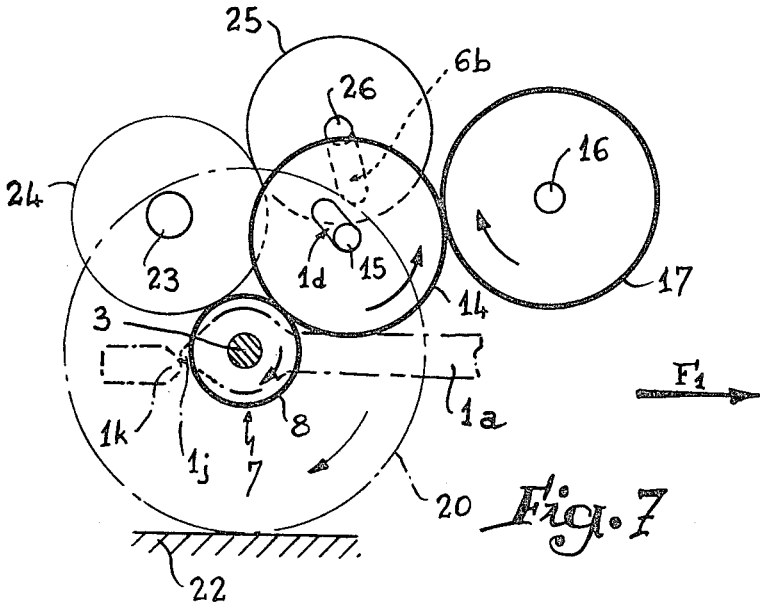
Figure 8:
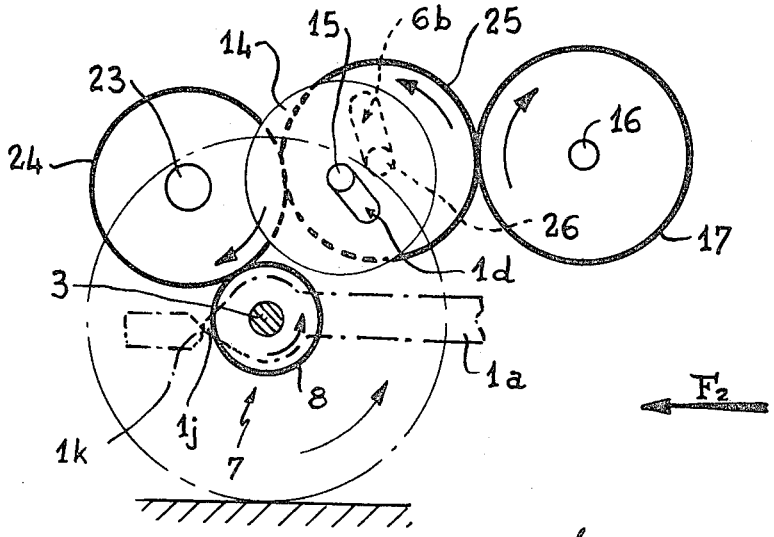

FIGS. 7 and 8 schematically illustrate how the motor constructed according to the present variant is wound up.

Figure 4:
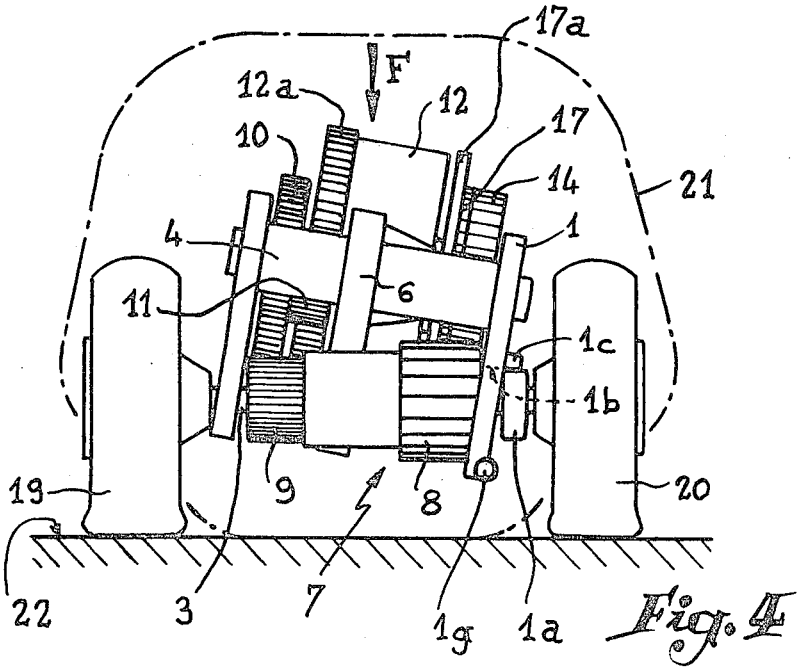
Figure 9:
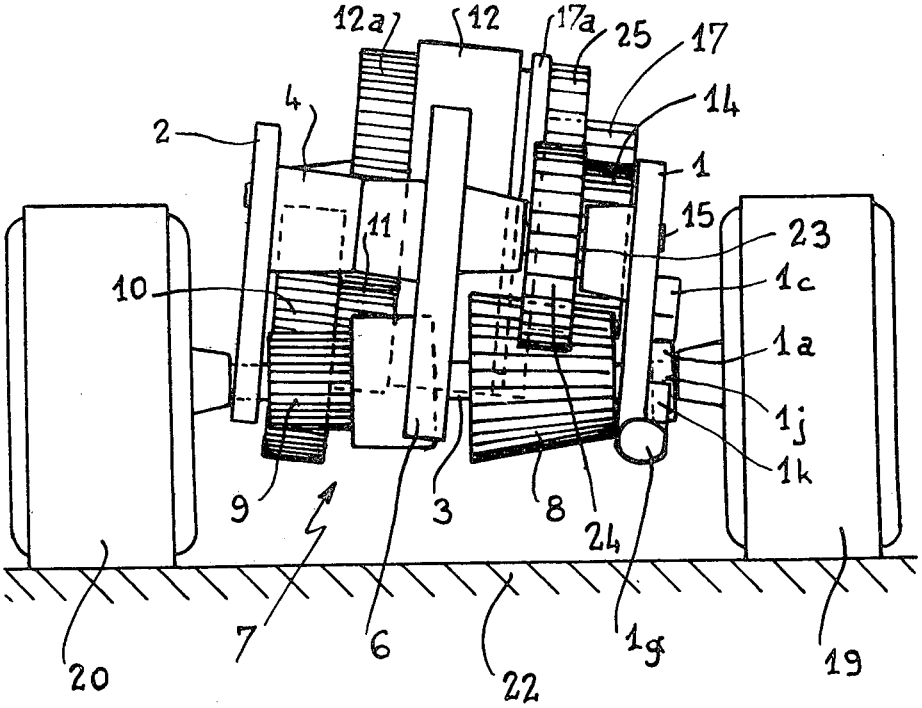

FIG. 9 is a rear view of the toy constructed according to the variant and which view corresponds to the view of FIG. 4.

Figure 1:
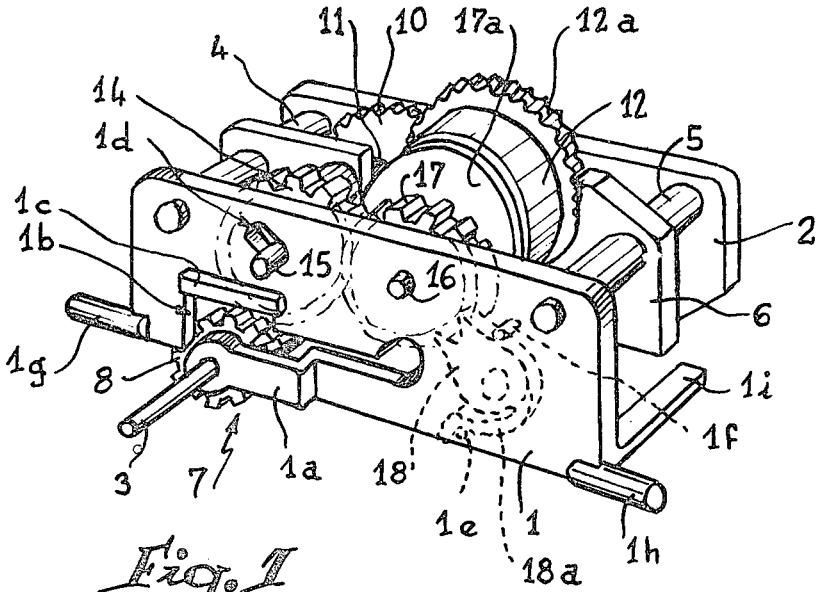
FIG. 1 is a view in perspective of a clockwork motor according to the invention.
Figure 2:
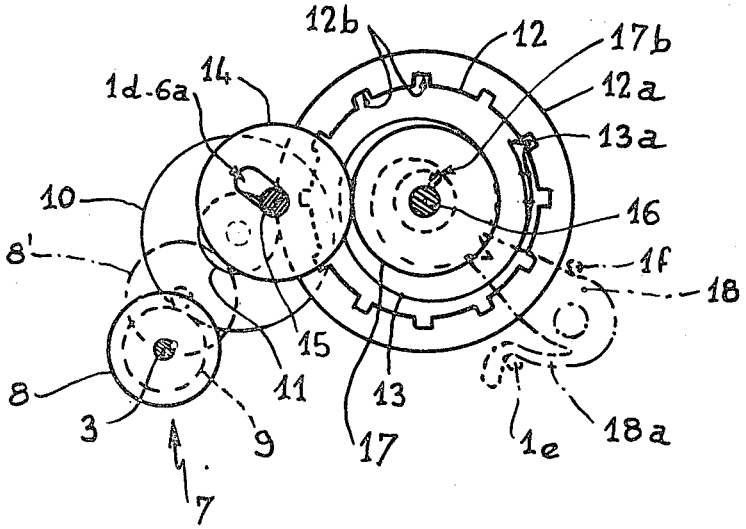
FIG. 2 is a diagrammatic side view of the members for winding up and driving this motor.

Referring now to the drawings, FIGS. 1 and 2 show a motor according to the invention comprising a train of gears disposed in a frame including two side members 1 and 2. Side member 1 is cut so as to present a lower arm 1*a* through which an axle 3 passes with functional clearance, at each of the ends of which axle are fixed the drive wheels of a toy vehicle which is propelled by the motor in question. The side members 1 and 2 are made of a suitable plastics material and arm 1*a* is sufficiently elastic to allow the vertical displacement of the axle adjacent to the side member 1. Of course, this side member is provided with a notch 1*b* located above the axle, as well as a stop 1*c* against which the axle abuts at the end of stroke.

The axle 3 passes through the side member 2 in an opening allowing it to rotate freely even in oblique position. Crosspieces 4 and 5 maintain the two side members at a determined distance from each other whilst fixing therebetween an intermediate plate 6.

On the axle 3 is angularly fixed a pinion 7 with two sets of teeth, one of which sets includes coarse teeth 8 located against the inner face of the arm 1*a* of the side member 1, whilst the other set includes finer teeth 9 located near the inner face of the other side member 2. This set of teeth 9 cooperates with a wheel 10 which is integral with a pinion 11 meshing with the ring gear 12*a* of a casing 12 inside which is housed a spiral spring 13, FIG. 2. The inside of the casing 12 is provided with notches 12*b* in which is placed the outer end 13*a* of the spiral spring 13. Thus, when said spring is wound up, it drives the works 9-10-11-12*a* and the axle 3.

The mechanism intended for winding up the spring comprises, apart from the teeth 8, a sliding pinion 14 whose pin 15 may move in oblique slots 1*d* and 6*a* made respectively in the side member 1 and the plate 6. The casing 12 is rotatively fixed on a pin 16 on which a winding up wheel 17 is journaled, said wheel being joined to a disc 17*a* which closes said casing. It is observed that a pawl 18 cooperates with the teeth of wheel 17 so that said wheel can rotate only in one direction (clockwise direction in the example shown). The pawl 18 is integral with an elastic finger 18*a* abutting on a fixed point 1*e* of the side member 1, whilst a stud 1*f* limits the movement of said pawl.

The lower part of the side member 1 is provided with two opposite longitudinal pivot pins referenced 1*g* and 1*h* respectively, whilst an elastic lug 1*i* extends perpendicularly to said side member in the direction of the other side member from the point of origin of the pivot pin 1*h*.

Figure 3:
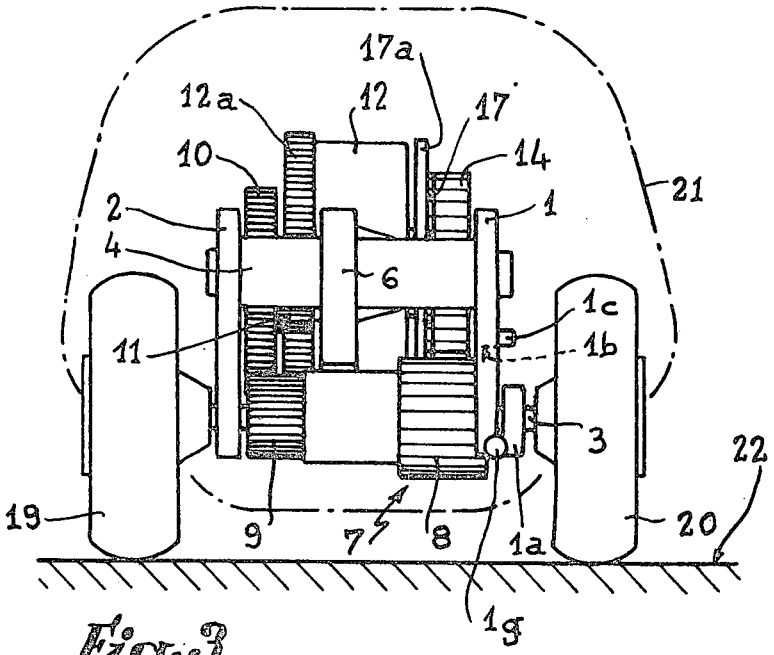
FIGS. 3 and 4 illustrate, on a larger scale, alternative relative positions of a motor according to the invention and of the bodywork of a toy vehicle with which it is associated.

As shown in FIG. 3, the axle 3 receives drive wheels 19, 20 so as to drive a toy vehicle of which the bodywork 21 has been shown schematically in dashed and dotted lines.

To wind up the spring 13 whose inner end is engaged in a slot 17*b* of the hub of the wheel 17, the bodywork 21 is pressed vertically in the direction of arrow F (FIG. 4). It therefore approaches the horizontal plane 22 on which the wheels of the toy vehicle rest. The pivot pins 1*g*, 1*h* of the side member 1 of the motor being engaged in perforations or with respect to open or closed bearings of the bodywork 21, the motor tilts against the reaction of the lug 1*i*, so that the axle 3 remains parallel to the plane 22 whilst the arm 1*a* is deformed so that the teeth 8 of the pinion 7 comes to 8' and meshes with the sliding pinion 14 (FIG. 2). If the vehicle is displaced in the direction of advance which corresponds to a movement towards the right in FIGS. 1 and 2, the drive applied to the pinion 14 by the teeth 8 moves the pin 15 in the slots and causes the pinion 14 to engage with the wheel 17 which then rotates clockwise, winding up the spiral spring 13. Of course, this advance also rotates the gear train works 9-10-11-12*a*, so that the casing 12 rotates in the same direction as the wheel 17. On the other hand, the ratio of the said gear train works is much higher than the ratio of the gear train including the pinion 7, the pinion 14 and the wheel 17, and therefore the relative movement of the casing 12 with respect to the winding up the hub of the winding up wheel 17 is much slower, thereby spring. Thus, it should be noted that the rotation of this casing unwinds the spring very slightly, with the result that the tension thereof is determined by the difference between the number of revolutions of the wheel 17 and that of said casing 12.

When the direction of displacement of the toy is reversed, whilst its bodywork remains pressed down, the toothing 8 rotates in anticlockwise direction so that its action on the pinion 14 displaces its pin 15 in the slot 1*d* towards the top thereof so that its teeth are disengaged from those of the wheel 17. The tension of the spring 13 is maintained by the pawl 18, thus blocking the rotation of the winding up wheel 17. On the other hand, the works 9-10-11-12*a* is being driven in opposite direction with respect to the unwinding direction corresponding to the earlier discussed movement of the toy vehicle so that the casing 12 rotates in anticlockwise direction, thereby further winding the spring. If each forward and rearward motion of the toy is of equal length, the casing 12 makes exactly the same number of revolutions in one direction and in the other; its opposed unwinding and unwinding action with respect to the tension of the spiral spring is therefore annulled, or it is at least largely compensated.

After a certain number of to and fro movements, the bodywork 21 is released, permitting the elastic return of the motor into elevated position with respect to the axle 3 so that the energy stored by the spring is transmitted to this axle which becomes a driving one via the works 9-10-11-12*a*. It will be noted that the spring is slackened outwardly against the casing 12 as the reaction produced by the inner end of the spring on the hub of the wheel 17 is maintained by the locking action of the pawl.

In the case of prolonged winding up, the spring cannot be subjected to an excessive tension with the risk of breakage, as, above a certain value of tension, its end 13*a* slips with respect to the casing 12 by jumping from one notch 12*b* to the other.

It will be noted that, despite the inclination of the pinion 7 when the bodywork 21 is in lowered position, its teeth 8 and 9 may mesh sufficiently with the sliding pinion 14 and the wheel 10 respectively due to the coarseness of the teeth 8 and of the pinion 14 and to the general clearance which may be allowed by such a mechanism.

Figure 5:
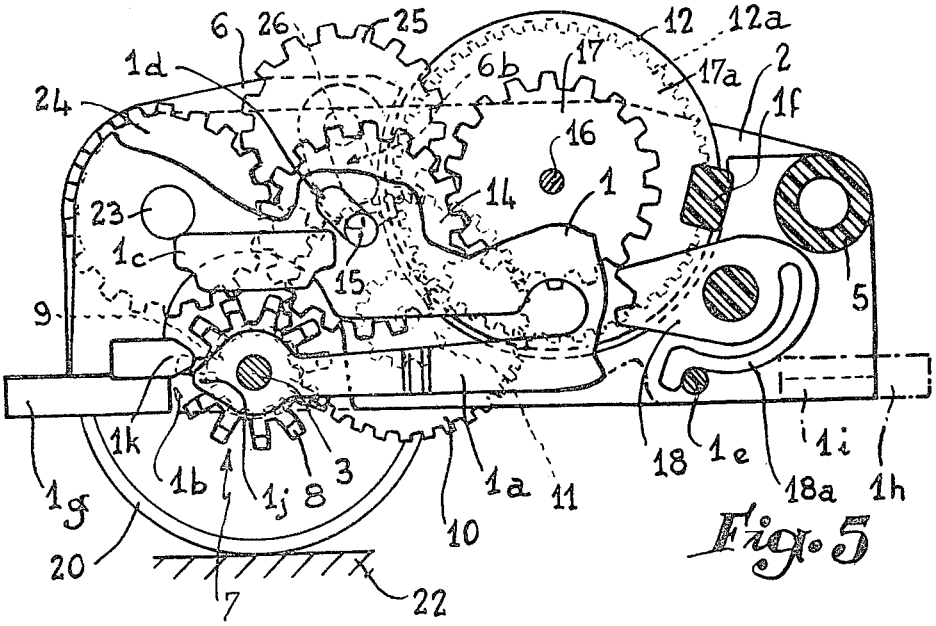
FIG. 5 is a longitudinal section through a motor constructed in accordance with a preferred variant embodiment of the invention.
Figure 6:
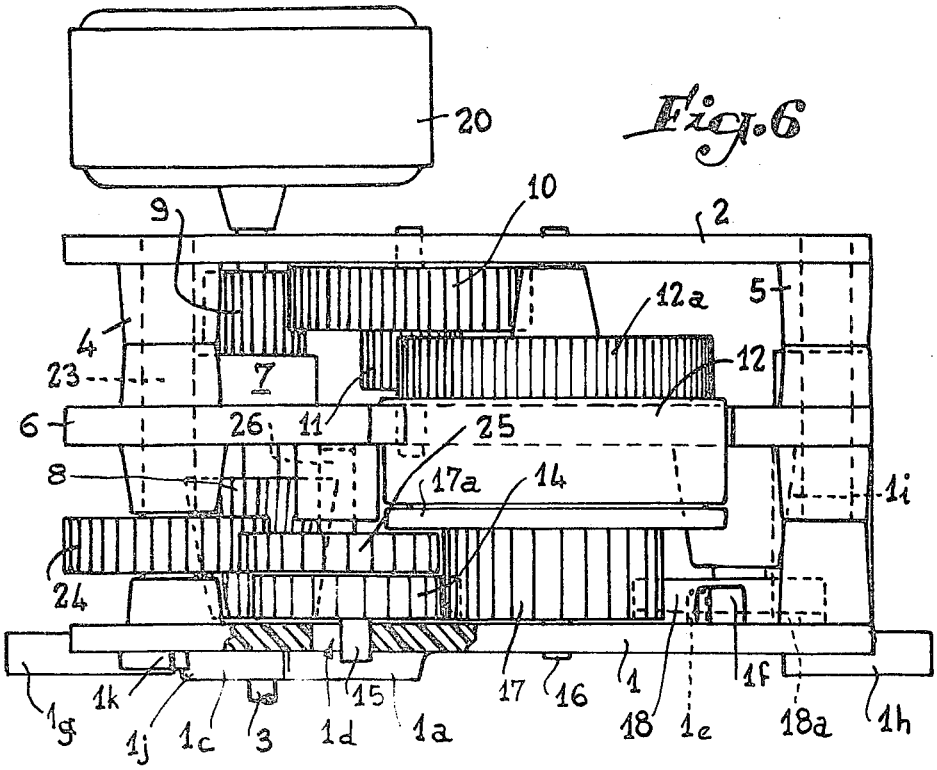
FIG. 6 is a plan view, one of the wheels not being shown.

FIGS. 5 and 6 show a motor constructed in accordance with a preferred variant. Between the side member 1 and the plate 6, a pin 23 rotates on which is fixed a pinion 24 which continuously meshes with a second sliding pinion 25 whose pin 26 is placed in a slot 6*b*. This pin extends toward and is supported only by plate 6 so that the pinion is mounted to overhang with respect thereto.

It will be noted that the pinion 14 is, according to the present variant, mounted in the same way, i.e. its pin 15 projects only in the direction of the side member 1 to be supported in the slot 1*d*. Thus, the opposite faces of the pinions 14 and 25 are completely smooth and rub against each other.

The pinion 17 has a width at least equal to the sum of that of the sliding pinions 14 and 25.

It will be observed that the end of the arm 1*a* is provided with a terminal catch 1*j* whilst the side member is provided with a corresponding interfering projection 1*k*. In rest position, the catch is located above the projection 1*k*. When the user presses down on the bodywork, this projection tends to move nearer the plane 22 on which the toy is resting. As it extends inside the notch 1*b* through movement greater than the distance which separates the end of the catch from the edge of this notch in question, the projection 1*k* engages with the catch 1*j* to deform the elastic arm 1*a* very slightly so as to come below the catch (FIG. 7). When the toy is released, the elasticity of the arm causes the projection to return to its initial position (FIG. 5). One is thus certain that the meshing of the pinions is positively effected to the full depth of the teeth.

The motor is wound up as follows:

When the bodywork has been pressed down under the conditions indicated hereinabove and the toy is moved in the direction of arrow F1, and the pinion 8 comes into mesh with pinion 24 and with pinion 14. Due to the rotation of the pinion 8, the pin 15 is applied in the bottom of the notch 1*d*, this corresponding to the position of engagement of the sliding pinion 14 with the winding up wheel 17. When the pinion 24 rotating in anticlockwise direction, it acts on the second sliding pinion 25 so as to displace its pin 26 against the upper end of the slot 6*b* so that this sliding pinion 25 cannot act on the winding up wheel 17.

On the contrary, when, at the end of the displacement stroke in the direction of arrow F1 which corresponds to the direction of advance of the toy, the latter is moved backward thereby reversing the direction of rotation of the pinion 8, the action of its teeth tends to push the pin 15 of the sliding pinion 14 upwardly in its slot, which sliding pinion is thus disengaged from the winding up wheel 17. The pinion 24 also changes its direction of rotation, this causing the pin 26 to lower to the bottom of the slot 6*b* so that the second sliding pinion 5 then meshes with the winding up wheel 17 so that further movement of the vehicle in the direction of the arrow F2 also winds the spring.

It goes without saying that, at the moment of the reversal of the directions of displacement, the pawl 18 blocks the winding up wheel 17 so that the spring is not slackened.

Finally, it will be noted that, as shown in FIG. 9, the pinion 8 is made conical so as to facilitate its engagement with the pinion 24 and the sliding pinion 14.

The propulsion of the wheels is controlled strictly as described with reference to FIGS. 1 to 4 by means of the works 9-10-11-12*a*.

It is obvious that the preceding description has been given solely by way of example and that it in no way limits the scope of the invention, the replacement of details of execution described by any other equivalents not departing from said scope. In particular, the elastic lug 1*i* could be oriented longitudinally instead of transversely.

What is claimed is:

1. A clockwork motor for driving a toy vehicle having axle supported drive wheels for rolling on a surface, comprising:

(a) a frame including a pair of spaced side members, the axle passing transversely therethrough and being journaled in a first one of said side members and resiliently supported in the second of said side members so that when the vehicle is pressed toward said surface the second end of the axle can be displaced upwardly in said second side member;

(b) first and second gears fixed on the axle;

(c) a casing journaled for rotation on a shaft extending between said side members, and a gear train connected between said first axle gear and said casing for transmitting rotational drive therebetween;

(d) a wind-up wheel having teeth therearound, the wheel being journaled on said shaft and having a hub entering said casing;

(e) a spiral spring in said casing and coupled at opposite ends respectively with said casing and with said hub of the wind-up wheel;

(f) means for limiting rotation of the wind-up wheel to displacement in a direction which winds the spring tighter; and (g) pinion means having pivots supported by the frame and shiftable toward and away from the wind-up wheel, the pinion means being engaged by the second axle gear when the vehicle is pressed toward the surface and being moved into engagement with the wind-up wheel teeth when the vehicle is rolled in the forward direction but retracted therefrom when the vehicle is rolled backward.

2. The clockwork motor as claimed in claim 1, wherein the second side member is made of an elastically deformable material and includes an elastic upwardly-displaceable arm in which the second end of the axle is journaled.

3. The clockwork motor as claimed in claim 2, wherein the second side member includes a stop to limit the upward displacement of the arm and second end of the axle.

4. The clockwork motor as claimed in claim 2, wherein said second side member and said arm respectively carry opposed projections which interfere when the arm moves up and down, said projections determining two distinct positions of the axle.

5. The clockwork motor as claimed in claim 1, wherein said rotation limiting means comprises a pawl pivoted to a side member and engaging the teeth of the wind-up wheel.

6. The clockwork motor as claimed in claim 1, wherein the vehicle has a body, and said frame has longitudinally extending pivot pins for mounting the members in the body so that the motor can tilt about the body when pressed toward said surface.

7. The clockwork motor as claimed in claim 6, wherein said pivot pins are carried by the second side member, and wherein an elastically displaceable lug carried by the frame engages the body and normally maintains the motor untilted inside the body.

8. The clockwork motor as claimed in claim 1, wherein said gear train has a higher reduction ratio from the axle to the casing, than the ratio of the second axle gear through the pinion means to the wind-up wheel.

9. The clockwork motor as claimed in claim 1, wherein said pinion means includes a first pinion having pivot means shiftably supported in the frame and operative to be moved by the second axle gear when the vehicle is pressed toward the surface to engage the wind-up wheel teeth when the vehicle is rolled forward and to be retracted therefrom when the vehicle is rolled backward, and further including a reversing gear engaged by the second axle gear when the vehicle is pressed toward the surface, and further including a second pinion having pivot means shiftably supported in the frame and operative to be moved by the reversing gear to engage the wind-up wheel teeth when the vehicle is rolled in the reverse direction and to be retracted therefrom when the vehicle is rolled in forward direction.

10. The clockwork motor as claimed in claim 9, wherein the first and second pinions have adjacent faces abutting each other and have pivot pins extending oppositely from the adjacent faces and shiftably supported in the frame for movement toward and away from said wind-up wheel.

11. The clockwork motor as claimed in claim 1, wherein the second gear on said axle is conical in shape so that when the axle tilts with respect to the side members when the motor is pressed downwardly the conical gear will mesh with said pinion means.

* * * * *